US009951936B2

(12) United States Patent
Hatfield

(10) Patent No.: US 9,951,936 B2
(45) Date of Patent: Apr. 24, 2018

(54) ACTIVE BABY ILLUMINATING SASH

(71) Applicant: Jaime R. Hatfield, Louisville, KY (US)

(72) Inventor: Jaime R. Hatfield, Louisville, KY (US)

( * ) Notice: Subject to any disclaimer, the term of this patent is extended or adjusted under 35 U.S.C. 154(b) by 0 days.

(21) Appl. No.: 15/530,325

(22) Filed: Dec. 22, 2016

(65) Prior Publication Data

US 2017/0219194 A1 Aug. 3, 2017

Related U.S. Application Data

(60) Provisional application No. 62/387,091, filed on Dec. 22, 2015.

(51) Int. Cl.

| | |
|---|---|
| ***F21V 23/04*** | (2006.01) |
| ***A41D 1/20*** | (2006.01) |
| ***A41D 27/08*** | (2006.01) |
| ***F21V 33/00*** | (2006.01) |
| ***F21V 21/08*** | (2006.01) |
| ***F21V 3/00*** | (2015.01) |
| *F21Y 115/10* | (2016.01) |

(52) U.S. Cl.

CPC ..... *F21V 23/0485* (2013.01); *A41D 1/20* (2013.01); *A41D 27/085* (2013.01); *F21V 3/00* (2013.01); *F21V 21/0832* (2013.01); *F21V 33/0008* (2013.01); *F21Y 2115/10* (2016.08)

(58) Field of Classification Search

CPC .... F21V 23/0485; F21V 3/00; F21V 21/0832; F21V 33/0008

USPC ..... 362/108

See application file for complete search history.

(56) References Cited

U.S. PATENT DOCUMENTS

| | | | | |
|---|---|---|---|---|
| 4,139,913 | A * | 2/1979 | Garin | A41F 9/025 2/221 |
| 5,109,421 | A * | 4/1992 | Fox | H04R 1/02 2/338 |
| 5,255,393 | A * | 10/1993 | Brady | A41D 1/20 2/409 |
| 5,491,756 | A * | 2/1996 | Francais | H04R 5/023 381/332 |
| 6,558,016 | B1 * | 5/2003 | Restauro | A41D 13/01 340/468 |
| 6,840,775 | B2 * | 1/2005 | Sailors | G09B 19/00 434/236 |
| 2002/0100103 | A1 * | 8/2002 | Pascal | A41D 1/005 2/102 |
| 2006/0007059 | A1 * | 1/2006 | Bell | A41D 27/085 345/55 |

(Continued)

*Primary Examiner* — Bryon T Gyllstrom

(74) *Attorney, Agent, or Firm* — Carrithers Law Office, PLLC

(57) ABSTRACT

A sash comprising a pressure sensitive material which reacts to the movements of an unborn baby and causes the illumination of corresponding areas of the sash on the mother's abdomen in response to the movement of the baby. The sash includes a strip of fabric or material of a selected size and shape to cover a selected portion of the abdomen of an expectant mother containing the baby. Means of fastening such as a hook and loop fastener are combined with an elastic belt secure the sash around the mother's abdomen. The touch sensitive fabric reacts to movements of the baby and causes lights over the active area to be illuminated. The result is a light show for viewers showing the unborn baby's activity.

4 Claims, 5 Drawing Sheets

(56) References Cited

U.S. PATENT DOCUMENTS

| | | | | |
|---|---|---|---|---|
| 2009/0201672 | A1* | 8/2009 | Lee | G08B 5/004 362/108 |
| 2009/0270012 | A1* | 10/2009 | Melarti | A41C 1/10 450/8 |
| 2011/0245737 | A1* | 10/2011 | Hawes | A61H 11/00 601/18 |
| 2016/0068214 | A1* | 3/2016 | Tang | B62J 6/00 362/108 |

* cited by examiner

ACTIVE BABY ILLUMINATING SASH

CROSS REFERENCE TO RELATED APPLICATIONS

This application claim priority from U.S. Provisional Application Ser. No. 62/387,091 filed on Dec. 22, 2015 which is incorporated by reference herein in its entirety.

TECHNICAL FIELD

The present invention relates to a pressure sensitive light emitting device used to monitor movements of an unborn baby in the mother's womb.

BACKGROUND OF THE INVENTION

Expectant mothers feel the unborn baby's movements in the womb as early as twelve weeks into the pregnancy. As the baby grows, the movements are more frequent and more noticeable. Many mothers will offer to allow the father, siblings or friends to place their hands where the movement is occurring. Family members especially take delight in experiencing the movements of the future member of the family. The instant invention permits observation of the baby movement without touching the mother.

Electronic textiles, also known as smart textiles, are fabrics that contain electrically conductive material that enable electronic devices and electrical wires or fibers to be woven in or imbedded within the fabric. The electrically conductive fibers which do not touch one another to complete a circuit touch and the electrical connections can be sensed and can cause electrical circuits to perform various tasks such as turning on a light, ringing a bell, causing a buzzer to sound or causing any selected function to be performed by any selected electrical or electronic device.

Clothing is now made using electronic textiles, as well. Shirts are available, for example, with certain areas which are illuminated when a particular area is compressed or energized with a switch to activate lights directly or in electrical communication with a power source via fiber optic fibers small wires coated with an insulating material. Various other articles of clothing can be used as displays which may be used for advertising wherein the wearer walks around a mall, for example, while his shirt provides an active billboard like display for advertisements. Alternatively, shirts or pants made from similar electronic textiles are used in games like tag, wherein, when a particular spot on a shirt is touched by an opponent, the shirt lights up to signify that the wearer of the shirt has been tagged.

U.S. Pat. No. 4,234,907 teaches a light emitting fabric which is incorporated by reference herein in ins entirety.

SUMMARY OF THE INVENTION

The function of the baby movement detection apparatus is to detect when an unborn baby moves inside the womb causing pressure to areas on the baby monitor. After the baby's arm or leg pushes outward on the surface of the mother's abdomen, a device will detect the resulting external pressure and will light up LED's to indicate that the baby has moved at the respective location.

The baby movement detection pressure sensitive and light emitting device 10 includes a light emitting member supported by flexible material. The light source is in electrical communication with a pressure sensitive layer comprising at least two layers of material including conductive elements, ("conductive material"), separated by a nonconductive layer of ("insulating material"). The layers may contain an electrically conductive mesh as a means of completing the circuit. In an inactive non-energized state or immobile resting position, the two separated layers of conductive material do not contact one another but are held apart by the nonconductive insulating layer. When the baby's movement pushes outward against the mother's abdomen and the three layers, the two layers of conductive material separated by the insulating material are pressed together whereby conductive elements make contact and are in electrical communication with one another forming a circuit with a battery through the layer of nonconductive mesh, thus passing voltage to light means or ("light emitting members"), such as LED's or fiber optic fibers in the connecting to a light means in electrical communication to the power, whereby the pressure on the light sensitive fabric provides a switch means connected to that particular area and causing the lighting elements to illuminate.

It is an object of the present invention to provide a removable sash or band of material or fabric which can be worn on an expectant mother's abdomen and which can sense the unborn baby's movement. LED's in the sash will illuminate the area over the mother's abdomen where the movement occurs.

It is contemplated that the light means may comprise a selected geometric or artistic pattern.

It is also contemplated that individual elements or groups of the light means may light up and be illuminated in a sequence or series upon activation.

It is also contemplated that a "blackout layer" of light and/or electrical shielding material worn as a bottom layer against the wearer may be used in combination with the pressure sensitive layer and the light sensitive layer in order to prevent or minimize exposure of the baby and/or mother to radiation and/or electrical stimulus.

It is contemplated that the light activation sequence can be recorded via a memory clip or be transmitted by a transmitter to a receiver such as a computerized smart device such as a watch, tablet, phone, computer or the like. The "light show" may be reproduced and synchronized with a selected time period or speeded up or slowed down to show movement over a given period of time.

In accordance with the present invention, there is provided a an active baby illuminating sash comprising, consisting of, or consisting essentially of strip of material including a flexible or stretchable portion and at least one illuminating fabric panel portion including at least one pressure sensitive layer of material including at least two layers having electrical conductive means separated by at least one an insulating layer disposed therebetween. An active luminous fabric is created by the addition of light means such as LED's or fiber optic threads disposed in the luminous fabric in electrical or light communication with a light source.

An embodiment comprises a pressure sensitive layer including an array of rows and columns of individual pressure sensitive elements disposed at selected positions over the pressure sensitive layer. The active luminous layer situated above or in close proximity and in electrical communication with the pressure sensitive layer is comprised of a single light means or an array of rows and columns or other selected pattern of individually active luminous areas which are located directly above the element and/or array of rows and columns of pressure sensitive areas. Each pressure sensitive layer can be positioned below individual active luminous areas which are caused to be illuminated when the pressure sensitive areas below are pressed completing a circuit. The fabric panel is sized to cover all or a selected portion of the abdomen of an expectant mother. The light emitting members are located within the individually active luminous areas. A power source, and electrical connections connecting the power source to the light emitting members and the pressure sensitive areas. The pressure sensitive areas are capable of conducting electrical current from the power source to the light emitting members located over the pressure sensitive areas. Optionally one or more elastic strap or belt portions are attached to a reinforced portion such as a lateral edge of the fabric panel with a fastener element attached to the other end. Another elastic belt or strap portion can be attached to the second lateral edge of the fabric panel with a second fastener element attached to the other opposing end.

In an alternate embodiment, there is provided an active baby illuminating sash comprising, consisting of or consisting essentially of a flexible, stretchable fabric panel having pressure sensitive layers in electrical communication with light emitting members defining luminous monitors arranged in an array of rows and column. Each of the monitors contains a bottom conductive layer comprising a polymer or rubber, plastic or an elastomeric material, a middle non-conductive layer comprising a film or sheet of a nonconductive polymer, and a top layer comprising a printed circuit board, preferably a flexible printed circuit board. The printed circuit board has spaced apart light emitting diodes, "LED's'" or other light emitting members such as a fiber optic thread visible on a top side in electrical communication with switching areas on a bottom side with the spaced apart light emitting members in electrical communication with a common positive solder pad and the switching areas in electrical communication with a common negative solder pad. The switching areas comprise two electrically isolated elements arranged adjacent to one another and exposed on the bottom side of the printed circuit board. The non-conductive layer has apertures formed therein which are aligned with the switching areas on the bottom side of the printed circuit board. The bottom conductive layer includes upward extending nodes which are aligned with the apertures in the non-conductive layer. The common positive solder pads of all monitors is in electrical communication with a positive terminal of a battery attached to the flexible, stretchable fabric panel. The common negative solder pads of all monitors is in electrical communication with a negative terminal of the battery. The middle non-conductive layer is compressible and causes the nodes to be isolated from the switching areas unless upward pressure is applied to a bottom side of the nodes. This pressure causes the top surface of the node to cause electrical contact between the two electrically isolated elements of the switching areas, and causes voltage to be applied across the corresponding LED resulting in illumination of the LED. A first fastener element is fixedly attached to a first lateral edge of the flexible, stretchable, illuminating fabric panel. A second fastener element is fixedly attached to a second lateral edge of the flexible, stretchable, illuminating fabric panel.

The baby movement detection pressure sensitive and light emitting device includes at least three layers: a printed circuit board, preferably a flexible printed circuit board; at least one conductive resilient layer with raised pads or nodes which align with switching areas on the printed circuit board; and a non-conductive insulating layer which separates and electrically isolates the printed circuit board from the conductive resilient layer. There are aperture such as slits or holes in the conductive layer which are aligned with the switching areas so that, when a selected amount of pressure is applied to the conductive layer, the nodes are distorted or pushed so that a portion thereof projects far enough through the holes to contact the switching areas and complete the circuit resulting in the respective switching areas to conduct voltage to the respective LED's, or other light emitting members causing them to illuminate. These three layers may or may not be covered by a protective layer on the side near the mother or an ornamental layer on the top side.

It is an object of this invention to provide an illuminating sash wherein the fabric covering the mothers abdomen includes layers of material including an elastic band, a conductive resilient layer containing pads or nodes, a printed circuit board with light emitting members such as LED's and switching areas containing two isolated conductive areas which are electrically connected when adjacent nodes of the conductive layer are pressed against them, and a nonconductive layer separating the printed circuit board from the conductive resilient layer.

It is an object of this invention to provide an illuminating sash which, when worn on the abdomen of an expectant mother, will illuminate areas under which a baby is exhibiting movement.

It is an object of this invention to provide an illuminating sash wherein the fabric covering the mothers abdomen may include a first layer of material which is opaque to prevent light radiation or electrical stimulation from passing through to the unborn baby and/or mother, a pressure sensitive layer including a first electrically conductive layer separating from a second electrically conductive layer by a insulating layer of non-conductive mesh, and a fourth light sensitive layer containing light emitting means such as a translucent or transparent—clear or colored light emitting means or light transmitting through a colored means for emitting colored light. The pressure sensitive layer constitute an electrical switch which only passes current when sufficient pressure is applied to compress the non-conductive insulating layer enough that the for the conductive layers to come into electrical contact with one another.

The illuminating sash may also include at least one two piece elastic belt used to removably and comfortably but firmly hold the illuminating fabric in place over the mother's abdomen.

The illuminating sash may include a lattice of LED's facing outward from the lattice to cause light to be emitted when corresponding areas of the sash have pressure applied by a baby kicking or pushing against that particular area of the mother's abdomen.

The illuminating sash may include a lattice of optical fibers which have been abraded or scored on an outward facing side of the lattice to cause light to be emitted from the abrasions or scores when particular fibers are illuminated by turning on a light such as an light emitting diode which is aimed at the ends of selected optical fibers.

It is another object of the present invention to provide a pressure and touch sensitive light emitting garment worn across the abdomen of a pregnant woman which provides a light show when the baby moves, kicks, and/or rolls.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided an active baby illuminating sash 10 which comprises a multi-layered movement pressure sensing and illuminating fabric which, when worn over the abdomen of an expectant mother is caused to be illuminated in particular areas where sufficient pressure is applied by the unborn baby to the sash.

As shown in FIGS. 1-13, the baby movement detection pressure sensitive and light emitting device, (illuminating sash or belt"), 10 includes a light emitting member supported by flexible material such as a fabric and includes a light source in electrical communication with a pressure sensitive layer. More particularly, the belt or sash 10 comprises or consists of a first layer having a rubber pad with nodules that are alignable with the "door" sensor on a circuit board. The second or middle layer comprise a thin film of plastic or other nonconducting material including aperture such as slits or holes sized with respect to the nodules in order for the nodules to pass there through upon receiving sufficient pressure to deflect or push the nodules through the hole to contact a circuit sensor. The third layer comprises a circuit board, preferably a flexible printed circuit board including light emitting members such as LED's in alignment with the nodules of the first layer and holes of the second layer in order to close the door "switch" upon depression of the sensor by the nodule closing the circuit and activating the light member.

Figure 1:
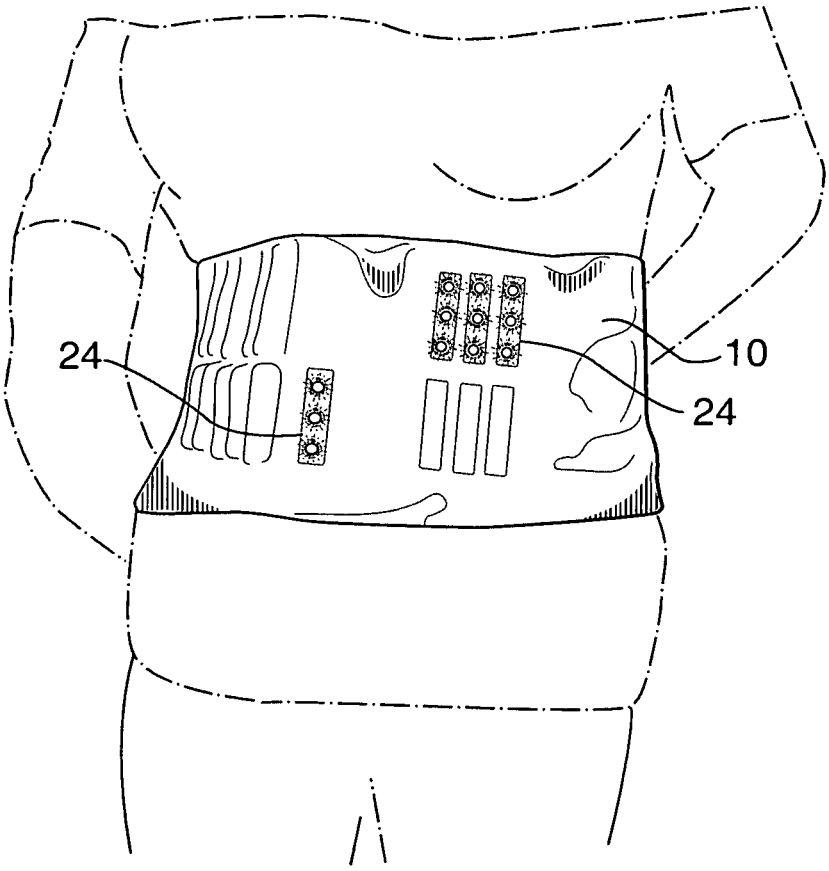
FIG. 1 is a front view of the illuminating sash as worn on a user showing depression of the surface of the fabric resulting in illumination of lights at the pressure points.
Figure 13:
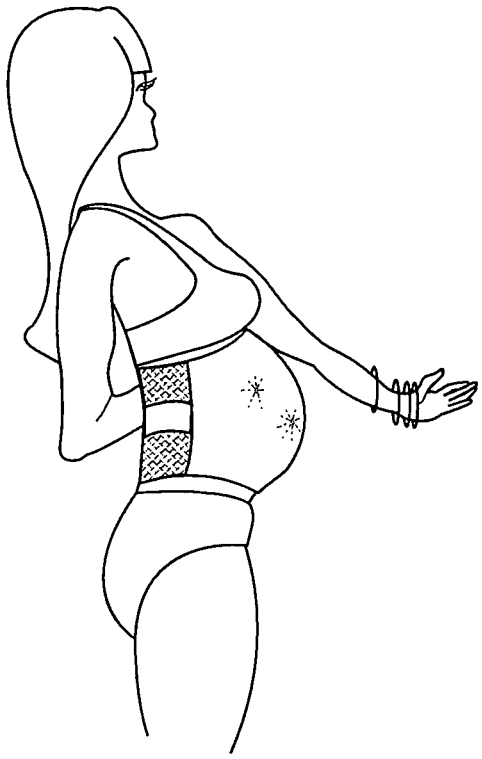
FIG. 13 is a side view showing the active baby movement detecting sash positioned on the abdomen of a woman.

As shown in FIGS. 1 and 13, the sash 10 is worn around a selected portion of the expectant mother's abdomen 5. The sash 10 is stretched around the mother's abdomen by holding means such as by hook and loop fasteners 16 and 18 attached to the inner distal ends of the sash or attached to a distal end of a strap in cooperative engagement with the distal end or selected portion of the sash 10. The sash 10 as shown in FIGS. 1 and 13 include at least a portion of a flexible and stretchable band of material 12 which may cover the entire garment or selected portion thereof. At one of the free ends of the band 12 is an area 16 including loop/hook fasteners 17 which cooperatively engage hook/loop fasteners 17 affixed to area 18 are attached at the opposite free end of the band 12. As the band 12 is stretched around the mother's abdomen, the hook and loop fasteners 16 and 18 are drawn toward one another and are then pressed together, causing the sash 10 having the light emitting members to be positioned over at least a selected portion of the mother's abdomen. Alternative embodiments of the sash contain fasteners such as a belt buckles, snaps, string ties, button/holes, or hook and eye fasteners rather than hook and loop fasteners.

The sash 10 includes a pressure sensitive layer of material including at least one layer of electrically conductive material, a layer of a non-conductive insulating material therebetween arranged forming a plurality of pressure sensitive areas providing touch sensitive and/or pressure sensitive switches at spaced apart intervals receptive to pressure over large areas of the sash powered by and in electrical communication with a battery 14 through leads 20. The battery connector with a cable or wire leads contain a positive lead and a negative lead such that leads are in electrical contact with the rectangular conductive material and lead and conductive band of material. The battery is then connected to connector so that the rectangular conductive material is held at a positive voltage but is electrically isolated from the conductive patches or monitors by the non-conductive material. The negative contacts on the PC boards are held at a negative voltage. The positive contacts on the PC boards are electrically floating. The non-conductive material keeps the conductive material from touching the conductive patches. If enough pressure is applied the depression of the nodes close the doors and conduct voltage through to the conductive material to illuminate the LED's on the respective PC boards.

Figure 2:
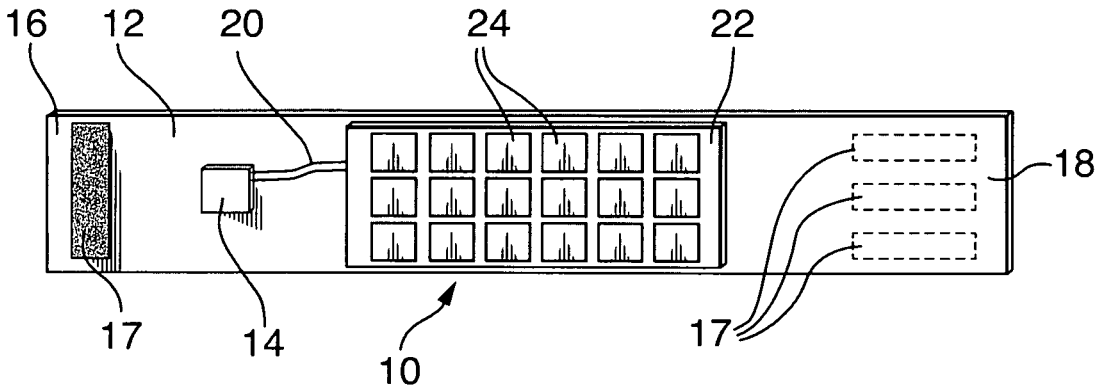
FIG. 2 is a front view showing the of the illuminating sash laid opening showing an section of the sash including hook and loop fasteners, multilayer pressure sensors and a battery.

Individual monitor patches 24 shown in FIG. 2 are each composed of three layers: a printed circuit board with spaced apart circuits driving LED's with switching areas, a layer comprising a rubber, elastomeric, or flexible plastic material with spaced apart pads or nodes extending upward, and a non-conductive layer of polymer film with spaced apart holes which are aligned with the nodes of the conductive layer and the switching areas of the printed circuit boards. The non-conductive layer electrically isolates the printed circuit board from the conductive layer except in the areas with the spaced apart holes.

The monitors 24 are about one and one half inch squares with a plurality of LED circuits. The example shown in FIGS. 3-5 has four rows of eight circuits for a total of 32 circuits per monitor. Monitors 24 with fewer or more circuits are possible depending only on the size of the circuit elements and the desired placement of these elements.

Figure 5:
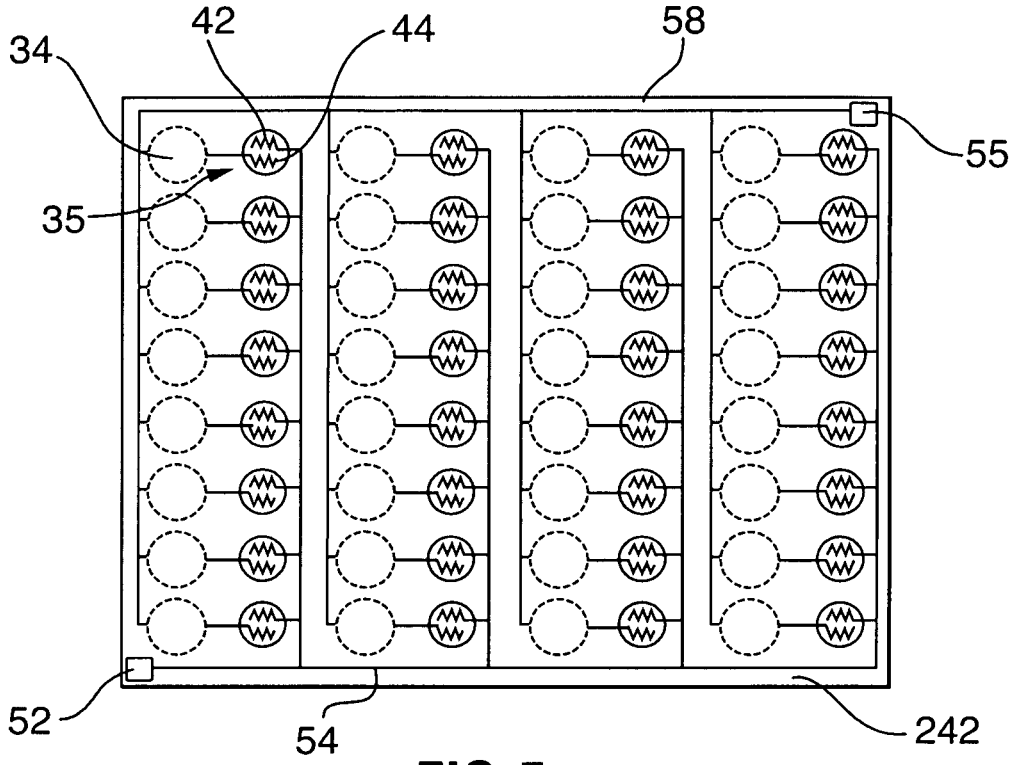
FIG. 5 is a bottom view of the printed circuit board with LED's on the top side and switching areas which are alignable with the spaced apart holes of the non-conductive layer of FIG. 4.
Figure 6:
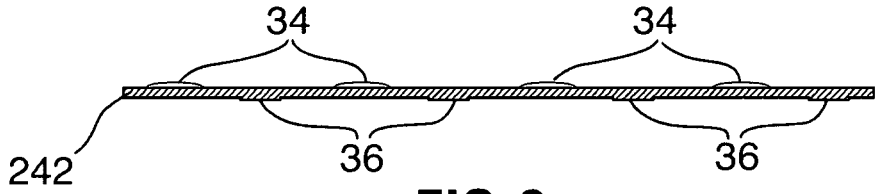
FIG. 6 is a side view of the printed circuit board showing the LED's on the top side and the switching areas on the bottom side.

The monitor 24 shown in FIG. 5 has four rows of eight LED circuits. The LED's 34 are shown in phantom lines because they are on the top side of the printed circuit board 242. The bottom side of the board 242 has the switching areas 36 which contain two raised zig-zag shaped conductive elements 42 and 44 along side one another. However, the two zig-zag shaped elements do not touch one another and are therefore, electrically isolated from one another. One end of all of the zig-zag elements 42 are connected by an electrically conductive track 54 to negative solder pad 52. One end of all of the zig-zag elements 44 is connected to the negative lead of respective LED's 34. The positive leads of all of the LED's are connected by an electrically conductive track 58 to the positive solder pad 56.

All of the positive solder pads 56 of all of the monitors 24 are wired to the positive lead of the battery 14 shown in FIG. 2. Likewise, all of the negative solder pads 52 of all of the monitors 24 are wired to the negative side of the battery 14.

Figure 4:
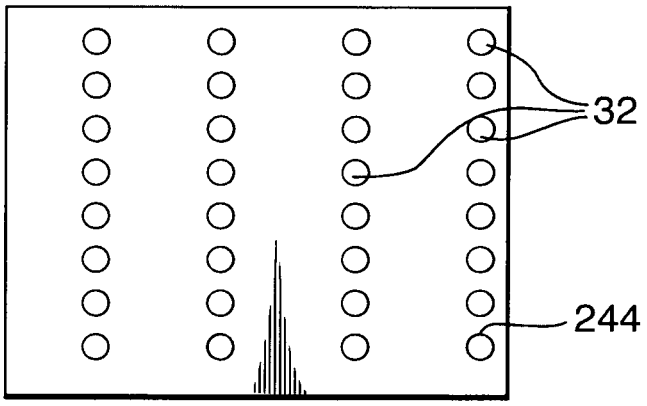
FIG. 4 is a top view of a non-conductive layer with spaced apart holes which are aligned and sized slightly larger with respect to the spaced apart nodes of the conductive layer in FIG. 3.
Figure 7:
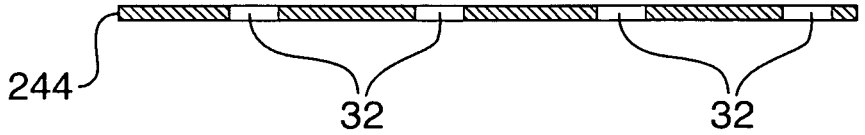
FIG. 7 is a side view of the non-conductive layer showing the holes alignable with the switching areas on the printed circuit board.

FIGS. 4 and 7 show a middle non-conductive layer 244 with a plurality of spaced apart holes 32 which are aligned with the switching areas 36 on the bottom of the printed circuit board 242. Thus, only the switching areas 36 of the printed circuit board 242 are exposed at the bottom when the non-conductive layer 244 is placed under the printed circuit board 242.

Figure 3:
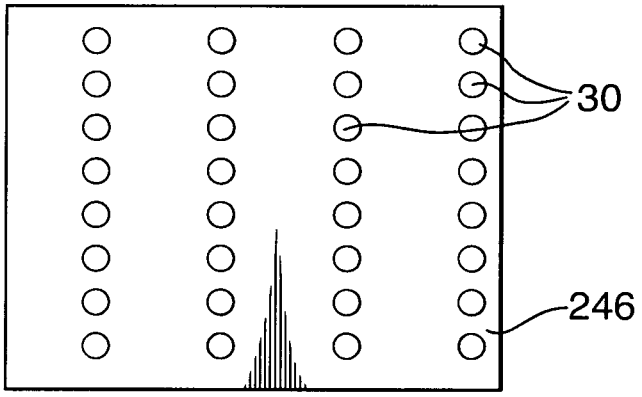
FIG. 3 is a top view of a conductive layer including spaced apart nodes extending upward from the layer.
Figure 8:
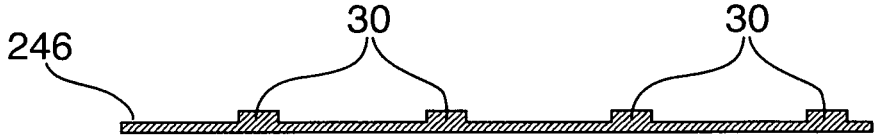
FIG. 8 is a side view of the conductive layer showing the upward extending nodes alignable with the holes in the non-conductive layer of FIG. 7.
Figure 9:
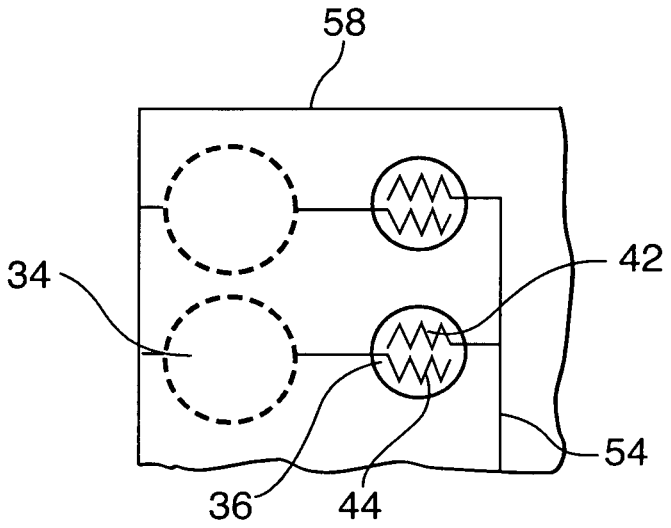
FIG. 9 is a schematic showing a portion of the printed circuit board having two circuits with LED's shown in broken lines connecting to switching areas and conductive tracks.
Figure 10:
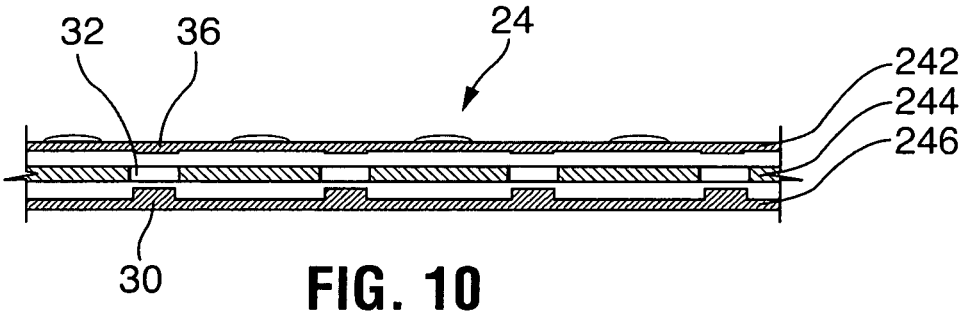
FIG. 10 is a side view showing the nonconductive insulating layer sandwiched between conductive layers comprising of the monitor.
Figure 11:
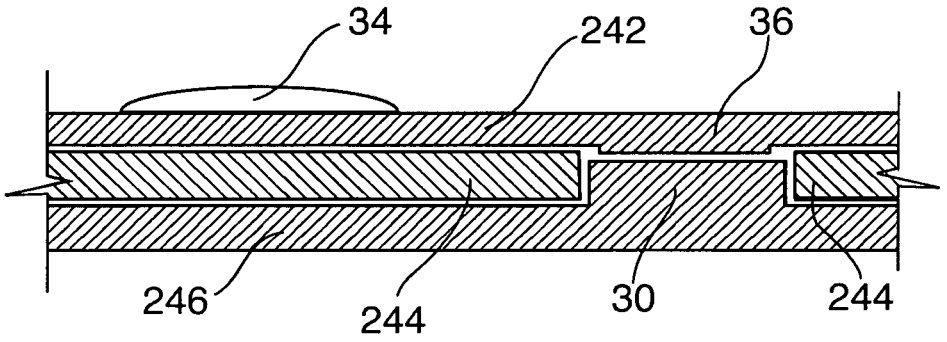
FIG. 11 is a sectional view of a portion of one of the LED circuits showing the non-conductive layer separating the conductive layer from the printed circuit board.
Figure 12:
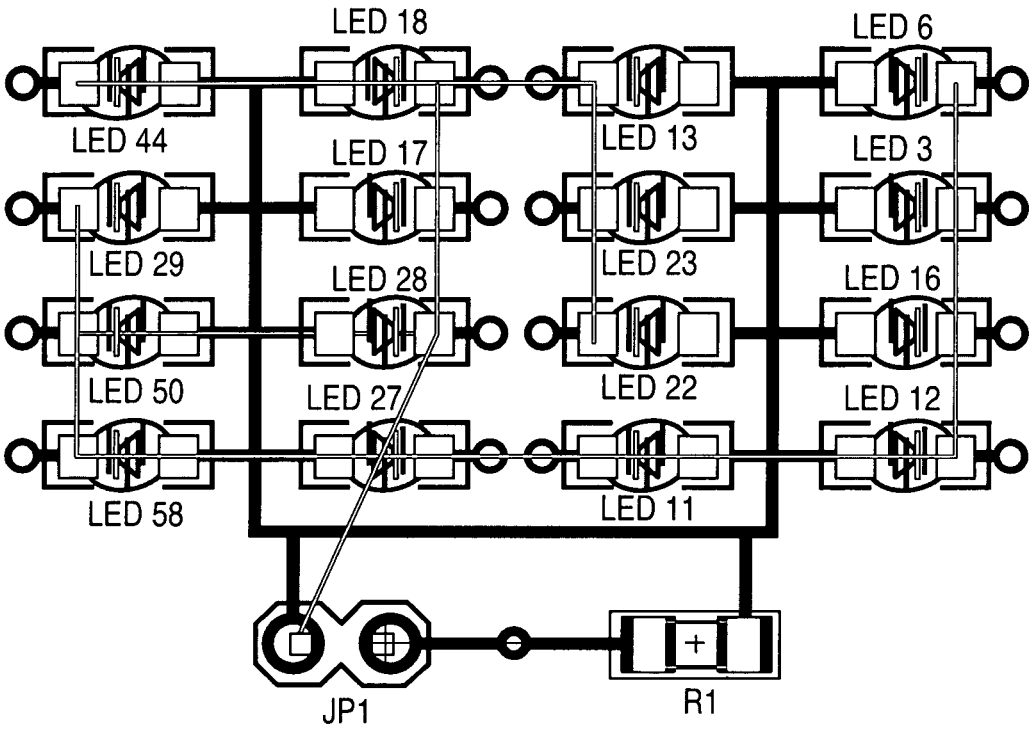
FIG. 12 is a top view of the LED printed circuit board showing the LEDs' and doors there between linked together.

FIGS. 3 and 8 show the conductive layer 246 with upward extending pads or nodes 30 which are aligned with the holes 32 of the non-conductive layer 244 when the two layers are brought together. With reference to FIG. 11, the non-conductive layer 244 is thick enough to keep the nodes 30 from touching the switching areas 36 when no pressure is applied. However, the non-conductive layer 244 is compressible and when upward pressure is applied to the bottom of the non-conductive layer 246 at or near the node 30, the top surface of the node 30 touches both of the conductive elements 42 and 44 of the switching area 36. Because the node 30 is conductive, when the top surface of the node 30 touches both of the conductive elements 42 and 44, voltage from the battery is now applied across the leads of the respective LED and the LED is illuminated.

The removable wearable sash 10 described above has an array of eighteen monitors 24 configured in six rows of three. It is anticipated that preferred embodiments of the sash have arrays with up to fifty areas or more with up to five or more rows of up to ten or more areas each. The number and configuration of the individually illuminated areas is limited only by the number and size of the monitor patches.

One preferred embodiment of the sash includes a transparent or translucent outer layer with ornamental colors and designs. Another preferred embodiment of the sash includes an opaque under the luminous and touch sensitive layers to guard against bright LED's shining through the abdominal wall and irritating the baby. Still another embodiment includes a reflective layer under the monitors 24 to reflect light upward away from the baby and out toward the intended viewers.

The removable wearable sash 10 described has at least one array and preferably a multitude of arrays configured in rows. It is anticipated that preferred embodiments of the sash have arrays with up to fifty areas or more with up to five or more rows of up to ten or more areas each. The number and configuration of the individually illuminated areas is limited only by the number and size of the monitor patches.

It is anticipated that other touch sensitive materials may be wired into an optical circuit similar to the one describe above. Likewise, other forms of illuminating fabric may be used to call attention to areas of pressure or movement caused by an unborn baby in the mother's abdomen.

The sash does may or may not include a transparent or translucent outer layer. It may also include an opaque, colored, and/or a reflective layer under the luminous and touch sensitive layers.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

I claim:

1. An active baby illuminating sash comprising:

a flexible, stretchable, illuminating fabric panel, said panel including a pressure sensitive area and an active luminous layer, said pressure sensitive area comprised of an array of rows and columns of individual pressure sensitive areas, said active luminous layer situated above said pressure sensitive areas and wherein said luminous layer is comprised of an array of rows and columns of individually active luminous areas, each of said pressure sensitive areas located directly below individual ones of said individually active luminous areas, each one of said pressure sensitive areas capable of causing said individually active luminous areas located directly above said pressure sensitive area to illuminate when said pressure sensitive area is pressed, said fabric panel sized to cover an abdomen of an expectant mother, said active luminous layer including light emitting members located within said individually active luminous areas, electrical connections connecting a power source to said light emitting members and said pressure sensitive areas, said pressure sensitive areas capable of conducting electrical current from said power source to said light emitting members located over said pressure sensitive areas when said pressure sensitive areas have pressure applied;

at least one first elastic belt portion fixedly attached to a first lateral edge of said flexible, stretchable, illuminating fabric panel, a free end of said first elastic belt portion having a first fastener element fixedly attached thereto; and at least one second elastic belt portion fixedly attached to a second lateral edge of said flexible, stretchable, illuminating fabric panel, a free end of said second elastic belt portion having a second fastener element fixedly attached thereto.

2. The active baby illuminating sash described in claim 1 wherein said flexible, stretchable, illuminating fabric panel is generally rectangular.

3. The active baby illuminating sash described in claim 1 including a protective translucent layer above said flexible, stretchable, illuminating fabric panel.

4. The active baby illuminating sash described in claim 1 including an opaque layer under said flexible, stretchable, illuminating fabric pane.

* * * * *